US009488334B2

(12) United States Patent
Riffel

(10) Patent No.: US 9,488,334 B2
(45) Date of Patent: Nov. 8, 2016

(54) ELASTOMERIC INDICATOR LIGHT LENS

(71) Applicant: BALLY GAMING, INC., Las Vegas, NV (US)

(72) Inventor: Brian Riffel, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 103 days.

(21) Appl. No.: 13/924,416

(22) Filed: Jun. 21, 2013

(65) Prior Publication Data

US 2014/0192535 A1 Jul. 10, 2014

Related U.S. Application Data

(60) Provisional application No. 61/750,949, filed on Jan. 10, 2013.

(51) Int. Cl.

| | |
|---|---|
| ***F21V 9/08*** | (2006.01) |
| ***F21S 8/00*** | (2006.01) |
| *F21W 111/00* | (2006.01) |
| *F21W 131/403* | (2006.01) |

(52) U.S. Cl.

CPC .. *F21V 9/08* (2013.01); *F21S 8/00* (2013.01); *F21W 2111/00* (2013.01); *F21W 2131/403* (2013.01)

(58) Field of Classification Search

CPC ..... F21V 9/08; F21V 33/008; F21V 1/22; F21V 5/046; F21V 1/00; F21V 5/043; F21V 1/06

USPC ..... 362/249.02, 231, 293; 340/815.43, 340/815.45

See application file for complete search history.

(56) References Cited

U.S. PATENT DOCUMENTS

| | | | | |
|---|---|---|---|---|
| 2,761,959 | A * | 9/1956 | Kunins | 362/281 |
| 4,344,115 | A * | 8/1982 | Pickens et al. | 362/216 |
| 6,220,731 | B1 * | 4/2001 | Ryan | 362/373 |
| 6,960,000 | B2 * | 11/2005 | Harrison | 362/216 |
| 7,063,432 | B2 * | 6/2006 | VanderSchuit | 362/101 |
| 7,401,935 | B2 * | 7/2008 | VanderSchuit | 362/101 |
| 7,677,761 | B2 * | 3/2010 | Chiang | 362/240 |
| 7,740,370 | B2 * | 6/2010 | Campbell et al. | 362/135 |
| 2008/0186700 | A1 * | 8/2008 | Curran et al. | 362/230 |

* cited by examiner

*Primary Examiner* — Anabel Ton

(74) *Attorney, Agent, or Firm* — Marvin A. Hein; Philip J. Anderson

(57) ABSTRACT

An indicator light includes at least one segment. Each segment includes a housing forming an interior and an exterior surface with a light source within. A light filter comprises a transparent or translucent stretchable elastomeric ring processed to pass a desired color and dimensioned to fit on the exterior surface of the housing.

8 Claims, 6 Drawing Sheets

ELASTOMERIC INDICATOR LIGHT LENS

FIELD OF THE INVENTION

The present invention relates to indicator devices for gaming machines and, in particular, indicator devices which use colored light for signaling.

BACKGROUND OF THE INVENTION

Gaming machines are often arranged in large numbers in a room. In such an environment, it can be difficult to tell if a particular gaming machine or its player needs assistance. An indicator light (sometimes referred to as a top light, tower light, light tower or candle) located on top of the gaming machine is easier to see, and is typically used to indicate that the gaming machine, or its player, needs assistance.

The indicator light typically comprises two or three differently colored segments. Each segment is optically separated from adjacent segments. When a particular segment of this indicator light is illuminated, it indicates to nearby personnel that some form of attendance is required at the location of the illuminated indicator light. The light color produced by the respective segments may provide information the gaming machine and/or about what assistance is required. For example, the color of some segments may indicate the denomination of the slot machine. The colors of other segments, including flashing lights, may convey to the casino operator that there is a malfunction, or that the coin hopper is full or empty, or that the player needs to paid out manually, or some other requirement.

In one known arrangement, each segment contains a white light source (typically a white light bulb). Surrounding each white light bulb in a segment is a colored film or gel, such as a red, yellow, blue, or green film, which produces a red, yellow, blue, or green light, respectively, when illuminated by the white light bulb. The light bulbs in the different segments are selectively illuminated to create color codes for the casino operators and/or the players.

In another known arrangement, each segment contains a light source of the desired color, e.g. a green light bulb, red light bulb, etc. When illuminated, the light bulb produces light of the color of that light bulb for that segment.

In yet another known arrangement, each segment contains a combination of sources of light in the primary colors, typically one or more of each of red, green and blue light emitting diodes (LEDs). The illuminating of one or more LED, and the intensity assigned to the respective LEDs, combines to produce a light of a desired color. For example, illuminating the red LED or LEDs produces a red light. Illuminating the red and green LEDs produces a yellow light, Illuminating the red, green and blue LEDs produces a white light, and so forth.

In the first arrangement, the colored film or gel may slip during use of the gaming machine due to the vibration of the machine. Further, when assembled, the ends of the colored film or gel may overlap, producing a line of darker color (see FIG. 5: 502). In the first and second arrangement, should a segment with a new color be desired, a replacement indicator light with the desired colored film or gel or light bulb must be ordered and produced. And the current indicator light must be replaced with the new indicator light. This can be a relatively expensive process requiring (a) purchasing the new indicator light, (b) taking the gaming machine out of service, and (c) replacing the old indicator light with the new one.

In the last arrangement, the physical structure of the indicator light does not need to be altered to change the color of the light produced by a segment. Instead, the color of the light produced by the segment is changed by changing the combination of LEDs illuminated and their relative intensities. However, this requires reprogramming of the indicator light controller, and possibly reprogramming the game controller, which may require recertification by regulators. Further, an indicator light including segments with multiple LEDs are more expensive than an indicator light containing only a white or colored light bulbs for generating the appropriate color light in the segment.

It is desirable to be able to change the color light produced by an indicator light segment easily and cheaply.

BRIEF DESCRIPTION OF THE INVENTION

In accordance with principles of the present invention, an indicator light includes at least one segment. Each segment includes a housing forming an interior and an exterior surface, a light source within the interior, and a light filter, dimensioned to fit on the exterior surface of the housing.

DETAILED DESCRIPTION

Figure 1:
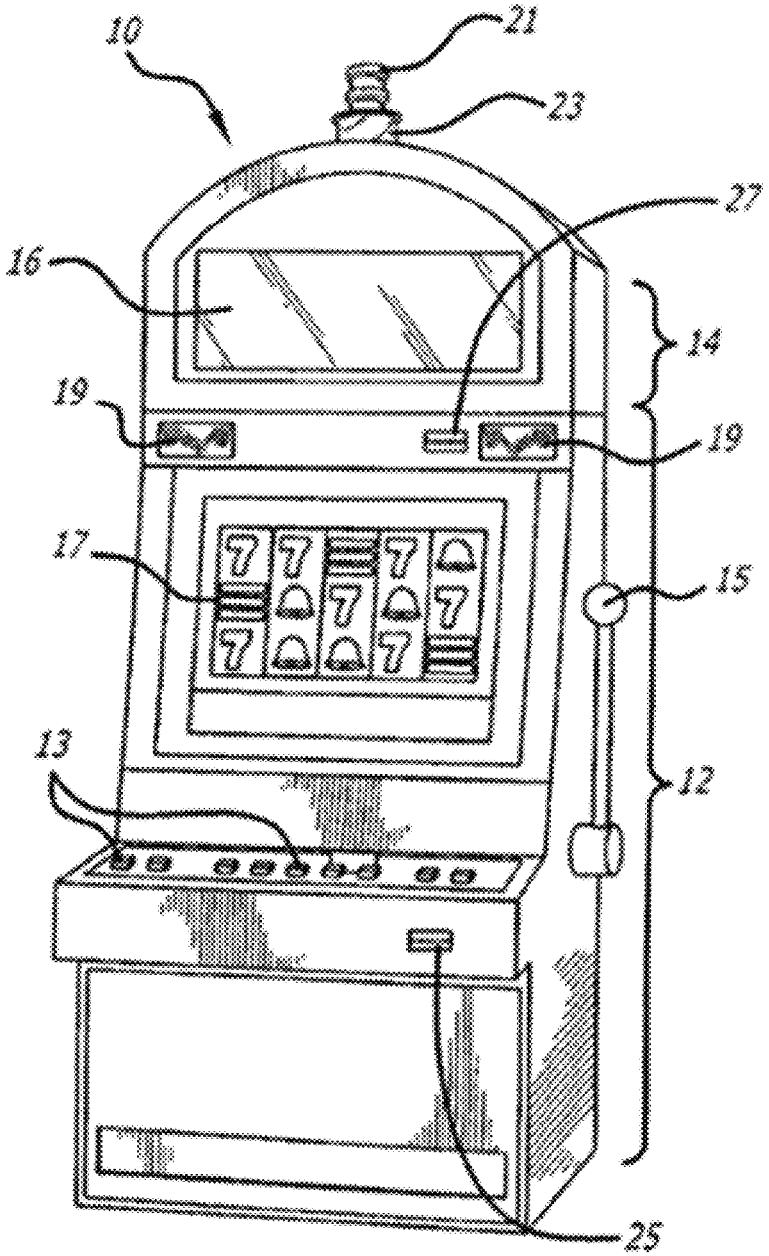
FIG. 1 is a perspective view of a gaming machine including an indicator light according to principles of the present invention.

In FIG. 1, a gaming machine 10 includes a main cabinet 12 and a top box 14. The top box 14 includes a display device 16, sometimes called a top box glass, which may be used for attracting attention, advertising the gaming machine or casino services, or other display items. The gaming device 10 also includes a main display device 17 that presents one or more game images; and various player input devices 13 and a handle 15 for use by a player to play the games. Speakers 19 present sounds to the player. A player identification card slot 27 may receive a player identification card from a player. In response to receiving such a card, the casino identifies and tracks the play of this player, and may reward the player for such play. A value input slot 25 receives value from the player in the form of coins, bills, or cash-equivalent tickets. In response to the receipt of value the gaming machine 10 will allow the player to play one or more games of chance upon manipulating the appropriate player activated buttons 13 or by pulling the handle 15. A indicator light 21 is affixed to a base 23, and provides light signals indicating that the gaming machine 10 requires attention from casino personnel, all in a known manner.

The main cabinet 12 of the gaming device 10 also houses a game monitoring unit (not shown). The game monitoring unit is connected to the circuitry of the gaming machine 10 and monitors the game, coin status, player winnings, and other functions of the gaming machine 10. The game monitoring unit includes a CPU, circuitry, and software for receiving signals from the player activated buttons 13, the handle 15, and the value input device 25. The game monitoring unit operates the games, and transmits signals to the respective game display 17 and speakers 19 presenting game images and sounds to the player. The game monitoring unit also sends monitored information to a backend server for processing. In various embodiments, the game program may be stored in a memory (not shown) comprising a read only memory (ROM), volatile or non-volatile random access memory (RAM), a hard drive or flash memory device, or any of several alternative types of single or multiple memory devices or structures.

The game monitoring unit also controls the indicator light 21 to illuminate an appropriate segment to shine a light of a desired color, and may blink that segment. For example, on a tilt condition, the game monitoring unit may control the indicator light 21 to illuminate a segment shining red light; on a large jackpot, the game monitoring unit may control the indicator light 21 to illuminate a segment shining green light; and in the event the player needs assistance (e.g. would like help, or a drink), the game monitoring unit may control the indicator light 21 to illuminate a segment blinking white light. One skilled in the art understands that the colors and blinking characteristics may be defined by the regulatory agency for the location of the gaming machine. Further the colors and blinking characteristics may be different between one regulatory jurisdiction and another.

Figure 2A:
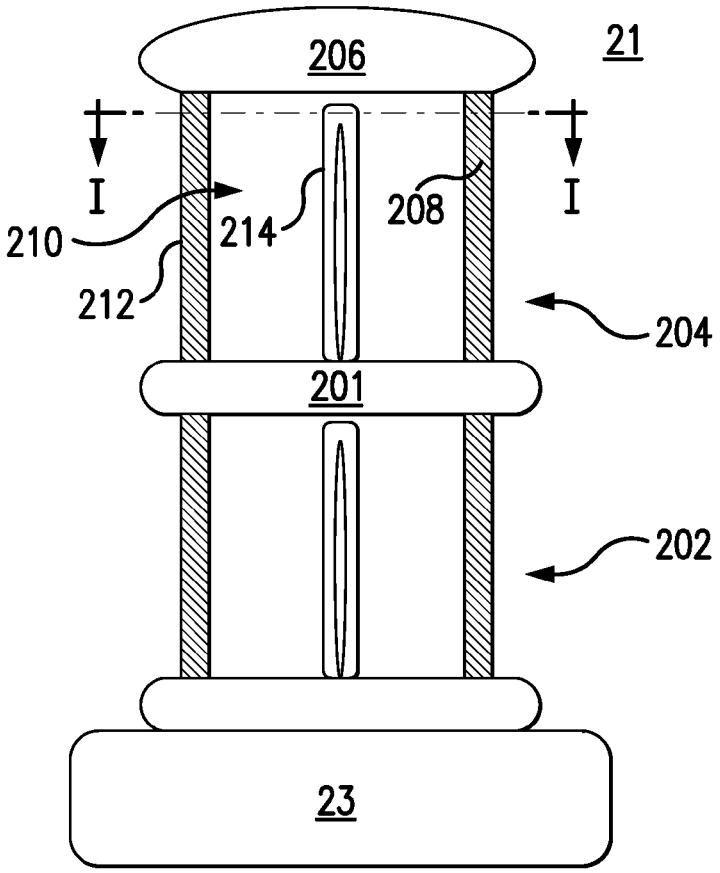
FIG. 2A PRIOR ART
FIG. 2A is a side view and FIG. 2B is a cross-sectional top view of an indicator light which may be affixed to a gaming machine as illustrated in FIG. 1.
Figure 2B:
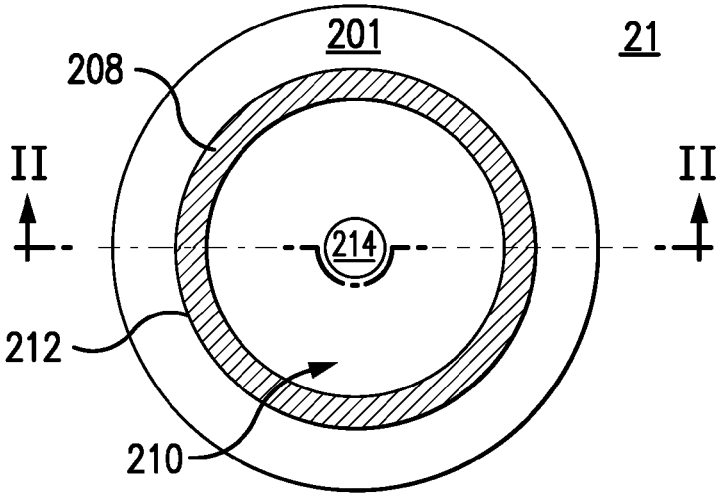
FIG. 2B PRIOR ART

FIG. 2A is a cross-sectional side view (along II-II) and FIG. 2B is a cross-sectional top view (along I-I) of an indicator light 21 which may be affixed to a gaming machine as illustrated in FIG. 1. In FIG. 2A, an indicator light 21 is mounted on a base 23. The base 23 is mounted to a gaming machine 10 as illustrated in FIG. 1. The indicator light 21 includes a first segment 202 and an adjacent second segment 204. A cap 206 is affixed to the top of the indicator light 21. The first segment 202 and second segment 204 are fabricated identically. Consequently, only the segment 204 will be described in detail below.

Referring now to FIG. 2A and FIG. 2B in combination, segment 204 includes a base 201. A housing 208 is mounted on the base 201 forming an exterior surface 212 and an interior 210. The housing 208 is transparent or translucent. Within the interior 210 is a light source 214, which is illustrated in FIG. 2 as an elongated light bulb. In the illustrated embodiment, this light bulb produces white light. One skilled in the art understands that any source of light 214 may be fabricated within the housing. Preferably the source of light 214 is arranged so that even lighting, e.g. without hot spots or shadows, is applied to the housing, producing relatively even lighting on the exterior surface of the housing 208. One skilled in the art understands that this may be provided by mirroring or other similar light shaping (not shown) also fabricated within the interior 210 of segment 204. The housing 208 may also include some sort of diffusion mechanism such as a frosted coating. This further prevents hot spots or shadows from appearing on the outside of the light tower 21 segment 202, 204.

The game monitoring unit (described above) sends control signals to the indicator light 21 controlling the segments 202, 204 to illuminate the light source as appropriate. Alternatively, an indicator light controller (also not shown) may control the light sources in response to signals from the game controller, all in a known manner.

Figure 3A:
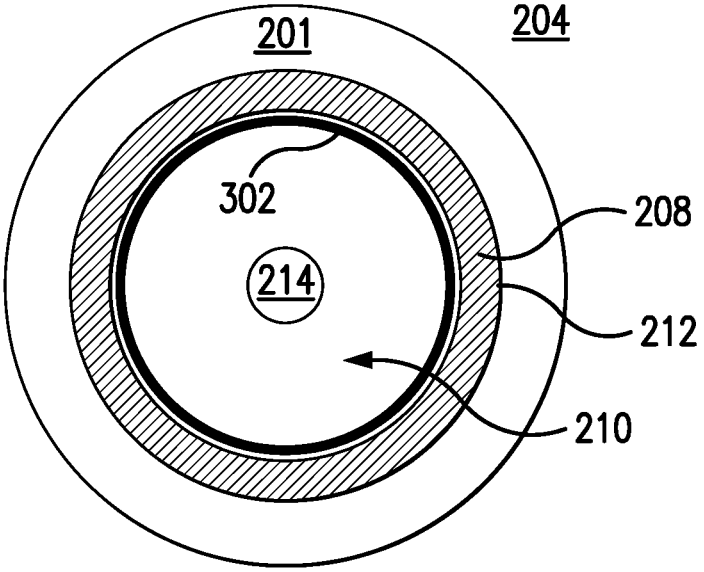
FIG. 3A PRIOR ART
FIGS. 3A, and B are transverse cross-sectional diagrams of a segment of prior art indicator lights.

FIGS. 3A, and B are top view cross-sectional diagrams, along I-I of FIG. 2A, of respective segments of prior art indicator lights. In FIG. 3 those elements which are the same as those illustrated in FIG. 2B are designated with the same reference numbers and will not be described in detail below. FIG. 3A illustrates a prior art embodiment of an indicator light segment 204. In FIG. 3A, a relatively thin colored film or gel 302 is placed within the interior 210. This colored film or gel 302 is placed between the light source 214, typically a source of white light, and the housing 208. Typically, it is placed near the inside surface of the housing 208, as illustrated in FIG. 3A. It reaches around the entire circumference of the inside surface of the housing 208, and spans the height of the segment housing 208.

In operation, the light source 214 is controlled by the gaming machine 10 (FIG. 1). When the light source is illuminated, the colored film or gel 302 passes colored light which may be seen through the housing 208. In order to change the color of the segment 204, the entire indicator light 21 assembly (FIG. 2) must be replaced with one including the appropriately dyed color film or gel 302 in the segment 204. Then the old indicator light is removed and the new indicator light is installed.

Figure 3B:
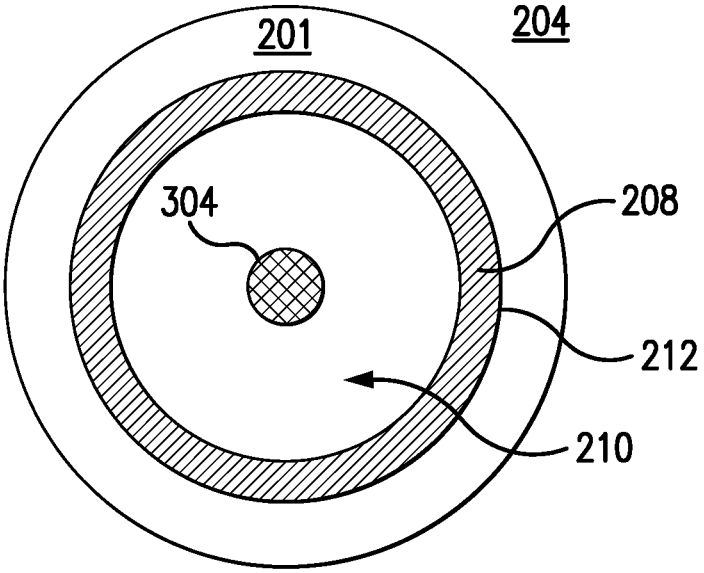
FIG. 3B PRIOR ART

FIG. 3B illustrates another prior art embodiment of an indicator light segment 204. In FIG. 3B, a colored light source 304 produces light of the desired color. In operation, the light source 304 is controlled by the gaming machine 10 (FIG. 1). When the colored light source 304 is illuminated, it produces colored light which can be seen through the housing 208. In order to change the color of the segment 204, the entire indicator light 21 assembly (FIG. 2) must be replaced with one including a new colored light source 304 producing light of the appropriate color in the segment 204. Then the old indicator light is removed and the new indicator light is installed.

Both of these prior art indicator lights require purchasing a new indicator light assembly if it is desired to change the color of a segment in the indicator light. This is expensive, and requires that the gaming machine be taken out of service for the time it takes to replace the old indicator light with the new one.

Figure 4A:
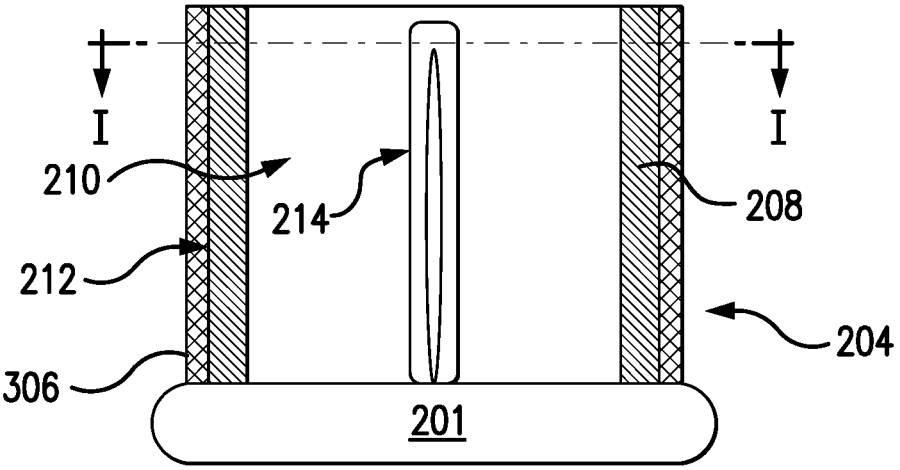
FIG. 4A is a side view and FIG. 4B is a cross-sectional top view of an indicator light according to principles of the present invention.
Figure 4B:
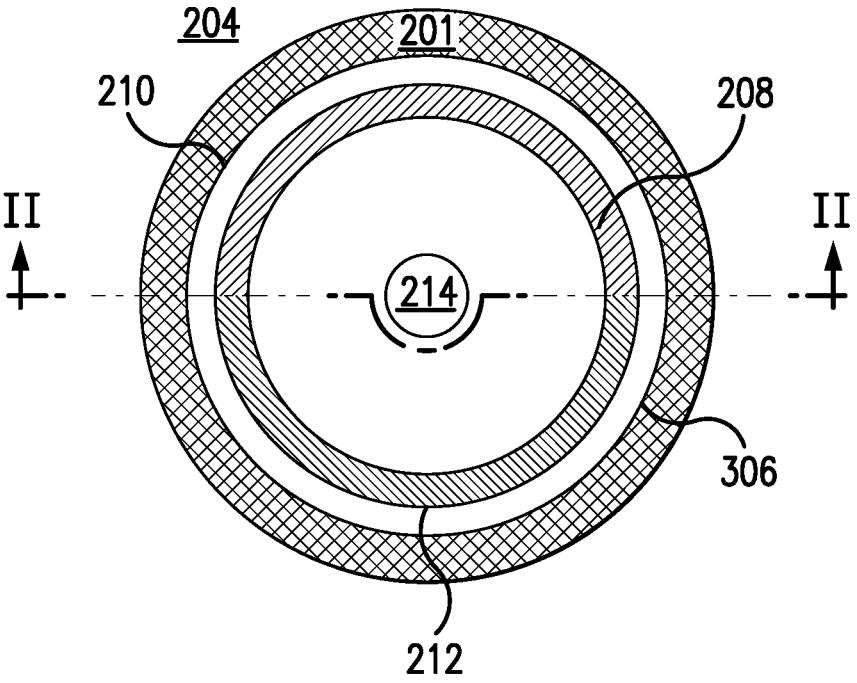
Figure 5:
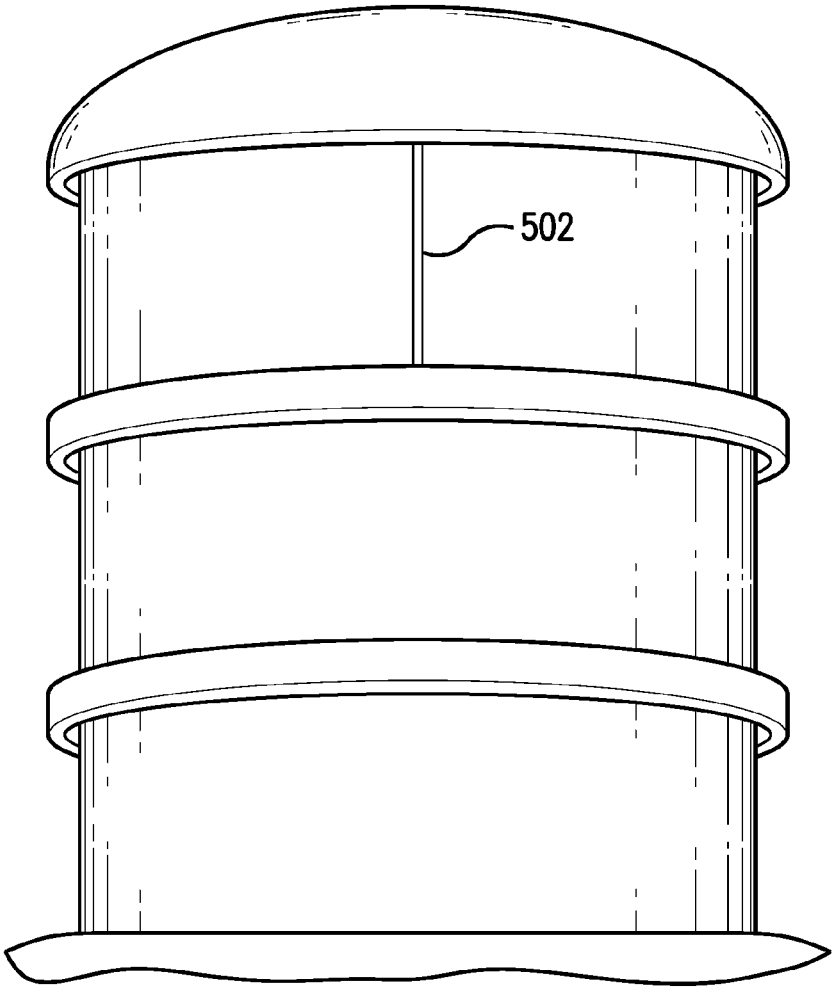
FIG. 5 is a gray scale picture of an indicator light illustrating a situation where a color film or gel overlaps within a segment.

FIG. 4A is a cross-sectional side view (along II-II) and FIG. 4B is a cross-sectional top view (along I-I) of an indicator light segment 204 according to principles of the present invention. In FIG. 4A, the light source 214 is preferably a source of white light. An elastomeric ring 306 surrounds the entire circumference of the exterior surface 212 and the height of the segment 204. The elastomeric ring 306 is dyed with the desired color.

In operation, when the light source 214 is illuminated, the light from the elastomeric ring 306 is the desired color. In order to change the color of the segment 204, the elastomeric ring 306 is removed, and one of the desired color is placed on the desired segment as described above.

The elastomeric ring 306 is fabricated of a material which is stretchable, translucent or transparent, and dyed, or otherwise processed, to pass light of the desired color. The material may be stretched to fit over the outside of the candle 21 (FIG. 2) mounted on the gaming machine 10 (FIG. 1). In particular, the material is sufficiently stretchable to fit over the cap 206 and segment bases 201. When in the proper position, the elastomeric ring 306 is held in position by the inherent elastic resistance. Preferably, this material is a silicone based material such as those proprietary to and manufactured by Boyd Industries. One skilled in the art understands that any material which is transparent or translucent, may be dyed to transmit light of a desired color, and is stretchable to fit over the cap 206 and segment bases 201 of an indicator light assembly 21 may be utilized.

Figure 6A:
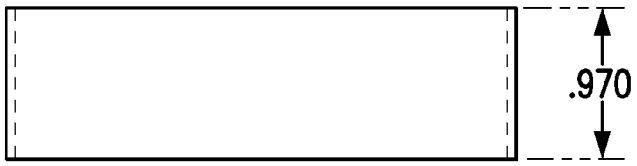
FIG. 6A and FIG. 6B illustrate dimensions for an embodiment of an elastomeric ring according to the present invention.
Figure 6B:
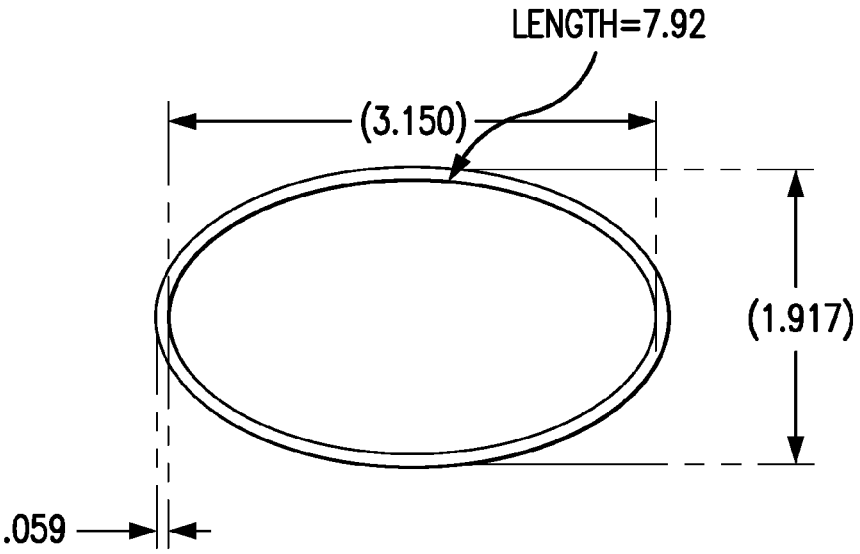

FIG. 6A and FIG. 6B illustrate-dimensions for an embodiment of an elastomeric ring according to the present invention. FIG. 6A is a side view of an elastomeric ring 306, and the vertical dimension is 0.97 inches. FIG. 6B is a top view of the elastomeric ring 306. One skilled in the art understands that this elastomeric ring 306 is intended for an ellipsoidal shaped indicator light and has a major diameter of 3.150 inches and a minor diameter of 1.917 inches. This results in a circumference of 7.92 inches The thickness of the elastomeric ring is 0.059 inches. This embodiment of an elastomeric ring 306 may be stretched over the cap 206 and segment bases 201 (FIG. 2) until it is over the exterior surface of the desired segment. One skilled in the art understands that elastomeric rings 306 of different cross-sectional shapes and sizes, and different heights to fit the indicator lights for which they are intended.

Although a light indicator has been described above in association with a gaming machine, such an indicator light may find application wherever a device may require manual attendance or assistance.

What is claimed is:

1. An indicator light, comprising:

at least two segments, the respective segments being optically isolated from each other, each segment comprising:

a segment base;

a housing mounted on the segment base, the housing being transparent or translucent and having an exterior surface and defining an interior;

a light source mounting on the segment base within the exterior surface;

a light filter, being stretchable, transparent or translucent, and processed to pass light of a desired color, dimensioned to fit over the indicator light and fit on the exterior surface of the housing of a segment.

2. The indicator light of claim 1, wherein the segment base optically isolates the respective segments.

3. The indicator light of claim 1, wherein the housing is transparent or translucent.

4. The indicator light of claim 1, wherein the light source emits white light.

5. The indicator light of claim 4 wherein the light source is a light bulb.

6. The indicator light of claim 4, wherein the light source is one or more light emitting diodes.

7. The indicator light of claim 1, wherein the light filter is transparent or translucent, is stretchable, and processed to pass light of a desired color.

8. The indicator light of claim 7 wherein the light filter is an elastomeric ring.

* * * * *